US006572347B2

(12) United States Patent
Nishio

(10) Patent No.: US 6,572,347 B2
(45) Date of Patent: Jun. 3, 2003

(54) FLUID APPARATUS SUCH AS A PUMP OR AN ACCUMULATOR

(75) Inventor: Kiyoshi Nishio, Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 0 days.

(21) Appl. No.: 09/774,073

(22) Filed: Jan. 31, 2001

(65) Prior Publication Data

US 2001/0014291 A1 Aug. 16, 2001

(30) Foreign Application Priority Data

Feb. 14, 2000 (JP) ..... 2000-034838

(51) Int. Cl.[7] ..... F04B 43/06; F04B 45/00

(52) U.S. Cl. ..... 417/395; 417/472; 137/599.12; 92/34; 366/131

(58) Field of Search ..... 417/394, 395, 417/472, 540; 137/512, 533.11, 533.13, 533.15, 599.12, 533, 225; 366/131, 184, 195; 92/34

(56) References Cited

U.S. PATENT DOCUMENTS

| | | | | | |
|---|---|---|---|---|---|
| 3,802,872 A | * | 4/1974 | Ostberg | 75/93 |
| 3,991,427 A | * | 11/1976 | Kemker | 4/192 |
| 4,275,752 A | * | 6/1981 | Collier et al. | 137/7 |
| 4,809,909 A | * | 3/1989 | Kukesh | 239/1 |
| 5,348,392 A | * | 9/1994 | Bouquet et al. | 366/162 |
| 6,024,345 A | * | 2/2000 | Nishio | 267/165 |

FOREIGN PATENT DOCUMENTS

| | | | |
|---|---|---|---|
| JP | 3-179184 | * | 8/1991 |
| JP | 10 196521 | * | 7/1998 |
| JP | 11-270460 | * | 10/1999 |

OTHER PUBLICATIONS

JetMix, The Vortex System, Liquid Dynamics Corp., Feb. 19, 2002.*

* cited by examiner

*Primary Examiner*—Charles G. Freay
*Assistant Examiner*—Han L. Liu
(74) *Attorney, Agent, or Firm*—Jones, Tullar & Cooper, P.C.

(57) ABSTRACT

The invention provides a fluid apparatus in which two or more kinds of chemical liquids can be rapidly stirred and mixed in a pump to a uniform concentration. A barrier membrane such as a bellows or a diaphragm that is reciprocally moved in the axial direction is disposed in a pump body so as to form a liquid chamber between the barrier membrane and an inner wall of the pump body. A suction port and a discharge port are disposed in the inner wall of the pump body. Supply pipes for the two or more kinds of chemical liquids are pipe-connected to an inlet portion of the suction port so as to join together. An outlet portion of the suction port is disposed in a side face of a protruding forward end of a suction check valve which is fixed to protrude from the inner wall of the pump body into the liquid chamber, whereby the outlet portion is opened so as to eject the two or more kinds of chemical liquids toward a circumferential wall in the liquid chamber. Therefore, the two or more kinds of chemical liquids which are separately supplied to the pump body are ejected from the outlet portion of the suction port so as to circulate along the circumferential wall of the liquid chamber. This circulating action causes the liquids to be stirred and mixed rapidly and uniformly in the liquid chamber.

4 Claims, 15 Drawing Sheets

FLUID APPARATUS SUCH AS A PUMP OR AN ACCUMULATOR

BACKGROUND OF THE INVENTION

1. Field of the Invention

The present invention relates to a fluid apparatus such as a bellows type pump, a diaphragm type pump, or an accumulator.

2. Description of the Prior Art

As a pump for circulating and transporting chemical liquids in various processes such as washing of surfaces of ICs or liquid crystal display devices in a semiconductor producing apparatus, used is a bellows type pump or a diaphragm type pump in which no particles are generated as a result of the pumping operation (for example, Japanese Patent Publication Laying-Open No. 3-179184). Many of such chemical liquids are mixtures of two or more different kinds of liquids. Mixing of such chemical liquids is performed by transporting two or more different kinds of liquids from different chemical liquid tanks to a mixing tank or a processing tank and then circulating the liquids, or by pouring such different kinds of liquids into a processing tank by different liquid pumps.

In the case where such a mixture of two or more kinds of liquids is used, it is important that the concentration of the liquid mixture is uniform and constant. In a process of uniformly mixing two or more kinds of liquids, when mixture is attained by circulating the liquids for a constant time period, however, the process requires an excessively long time period. It has been requested to solve this problem. When a stirring tank is separately disposed, the scale of the liquid circulating line is enlarged. This is not preferable.

SUMMARY OF THE INVENTION

The present invention has been conducted in order to solve the problems. It is an object of the invention to provide a fluid apparatus such as a pump or an accumulator which can exert functions of stirring and mixing two or more kinds of chemical liquids in a liquid chamber of the pump or the accumulator, so that a uniform liquid mixture can be rapidly obtained.

The fluid apparatus of the invention will be described with reference to the drawings. The reference numerals in the figures are used in this paragraph in order to facilitate the understanding of the invention, and the use of the reference numerals is not intended to restrict the contents of the invention to the illustrated embodiments.

As exemplarily shown in FIG. 1, the fluid apparatus of the invention is a fluid apparatus configured by a reciprocating pump in which a barrier membrane 7 such as a bellows or a diaphragm that is reciprocally moved in an axial direction is disposed in a pump body 1 so as to form a liquid chamber 9 between the barrier membrane and an inner wall of the pump body 1, a suction port 18 and a discharge port 19 are disposed in the inner wall 4*a* of the pump body 1 facing the liquid chamber 9, and a stroke of sucking two or more different kinds of liquids from the suction port 18 into the liquid chamber 9 by reciprocal motion of the barrier membrane 7, and a stroke of discharging the liquids in the liquid chamber 9 from the discharge port 19 are alternately performed. In the pump, an outlet portion 18*a* of the suction port 18 facing the liquid chamber 9 is opened so as to eject sucked liquids toward an inner peripheral wall 9*a* of the liquid chamber 9, the inner peripheral wall being located in a direction different from the axial direction, and supply pipes 5A and 5B respectively for the two or more kinds of liquids are pipe-connected to an inlet portion of the suction port 18 so as to join together.

In this case, in place of the means for supplying the two or more kinds of liquids to the pump in which the supply pipes 5A and 5B for the respective two or more kinds of liquids are connected to the inlet portion of the suction port 18 so as to join together as described above, as shown in FIG. 7, inflow paths 5 respectively for the two or more kinds of liquids may be individually disposed in the pump body 1, and outlets of the inflow paths 5 may be communicatingly formed in the inlet portion of the suction port 18 so as to join together in the inlet portion.

An outlet portion 18*a* of the suction port 18 may be disposed in a side face of a protruding forward end of a suction check valve 20 which is fixed to protrude from the inner wall 4*a* of the pump body 1 facing the liquid chamber 9, into the liquid chamber 9.

According to the thus configured fluid apparatus, since the outlet portion 18*a* of the suction port 18 is opened so as to eject the two or more kinds of sucked liquids toward the circumferential wall in the liquid chamber 9 which is located in a direction other than the axial direction, the two or more kinds of sucked liquids are ejected from the outlet portion 18*a* of the suction port 18 so as to circulate along the inner periphery of the liquid chamber 9. This circulating action exerts an effect of stirring the two or more kinds of sucked liquids. Therefore, the two or more kinds of liquids which are separately supplied to the pump are uniformly stirred and mixed in the liquid chamber 9.

As exemplarily shown in FIG. 5, the fluid apparatus of the invention is a fluid apparatus configured by an accumulator in which a barrier membrane 29 such as a bellows or a diaphragm that is reciprocally moved in an axial direction is disposed in an accumulator body 25 so as to form a liquid chamber 31 inside the barrier membrane, two or more different kinds of liquids being to flow into said liquid chamber, and an air chamber 32 outside the barrier membrane, an inflow port 23 and an outflow port 24 are disposed in an inner wall 28*a* of the accumulator body 25 facing the liquid chamber 31, and a liquid pressure in the liquid chamber 31 is balanced with an air pressure in the air chamber 32. In the accumulator, an outlet portion 23*a* of the inflow port 23 facing the liquid chamber 31 is opened so as to eject sucked liquids toward a circumferential wall of the liquid chamber 31, the circumferential wall being located in a direction other than the axial direction, and supply pipes 5A and 5B respectively for the two or more different kinds of liquids are pipe-connected to an inlet portion of the inflow port 23 so as to join together.

In this case, in place of the means for supplying the two or more kinds of liquids to the accumulator in which the supply pipes 5A and 5B for the respective two or more kinds of liquids are connected to the inlet portion of the inflow port 23 so as to join together as described above, inflow paths 33 respectively for the two or more kinds of liquids may be individually disposed in the accumulator body 25, and outlets of the inflow paths 33 may be communicatingly formed in the inlet portion of the suction port so as to join together in the inlet portion.

An outlet portion 23*a* of the inflow port 23 may be disposed in a side face of a protruding forward end of a discharge check valve 21 which is fixed to protrude from the inner wall of the accumulator body 25 facing the liquid chamber 31, into the liquid chamber 31.

Since the outlet portion 23*a* of the inflow port 23 is opened so as to eject the two or more kinds of inflow liquids toward the circumferential wall in the liquid chamber 31 which is located in a direction other than the axial direction, the two or more kinds of inflow liquids which are ejected from the outlet portion 23*a* of the inflow port 23 to circulate along the inner periphery of the liquid chamber 31. This circulating action exerts an effect of stirring the two or more kinds of sucked liquids. Therefore, the two or more kinds of liquids which are separately supplied to the accumulator are uniformly stirred and mixed in the liquid chamber.

DETAILED DESCRIPTION OF THE PREFERRED EMBODIMENT

Figure 1:
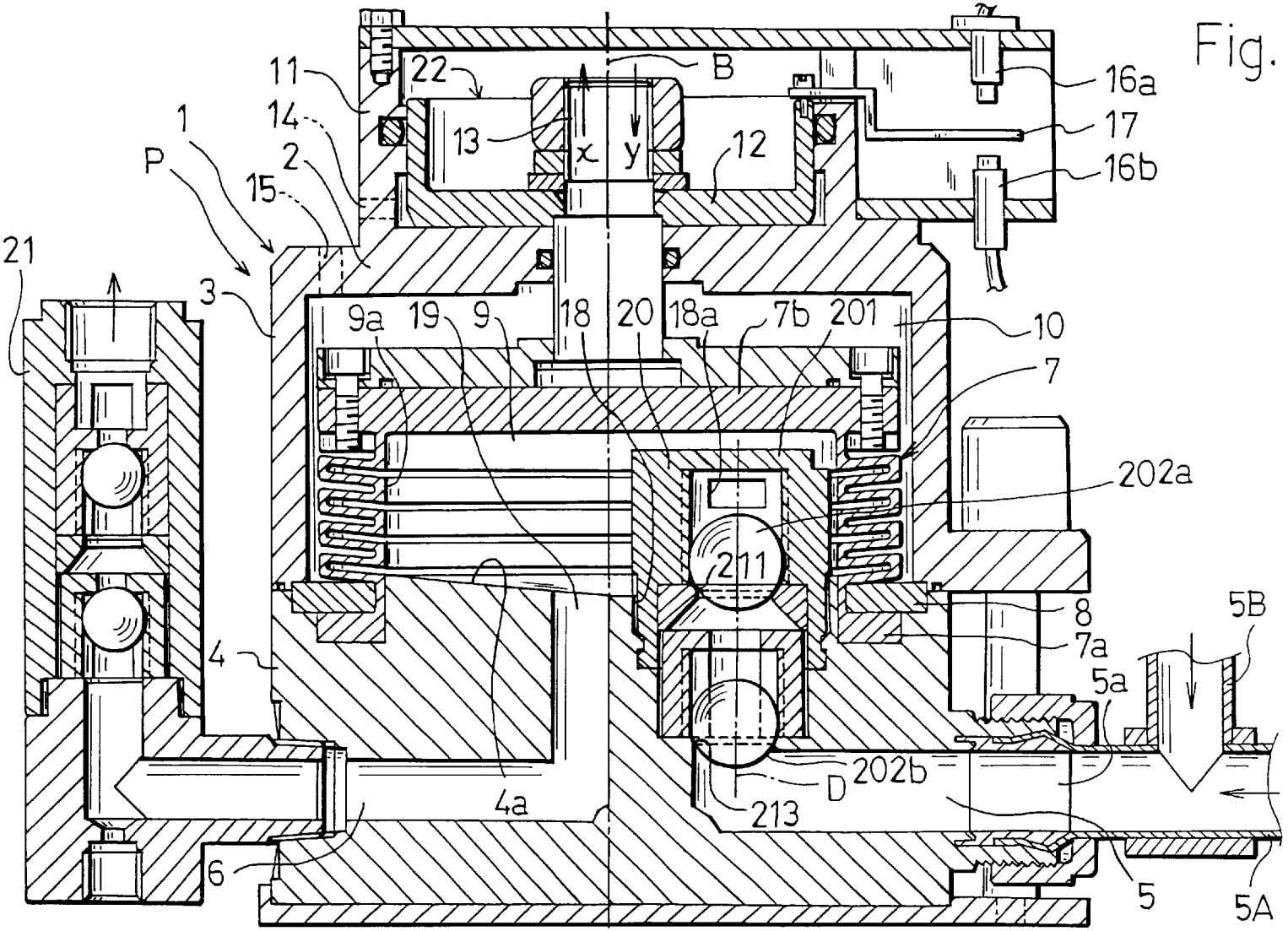
FIG. 1 is a longitudinal front section view of a reciprocating pump in a first embodiment of the invention.

FIG. 1 shows an embodiment in the case where the invention is applied to a reciprocating pump serving as a fluid apparatus.

Referring to FIG. 1, the pump body 1 of the reciprocating pump has a cylindrical casing 3 in which the upper end is closed by an upper wall 2, and a bottom wall member 4 which airtightly closes the open lower end of the casing 3. A liquid inflow path 5 and a liquid outflow path 6 are formed in the bottom wall member 4. Supply pipes 5A, 5B, . . . respectively for two or more different kinds of liquids are connected to an inlet portion 5*a* of the inflow path 5 so as to join together.

A barrier membrane 7 configured by a bottomed cylindrical bellows which is expandingly and contractingly deformable in the direction of the axis B of the casing 3 is disposed in the casing, while vertically directing the axis B of the barrier membrane. The barrier membrane 7 is made of a fluororesin which is excellent in heat resistance and chemical resistance, such as PTFE (polytetrafluoroethylen), or PFA (perfluoroalkoxy). An opening peripheral edge 7*a* of the lower end of the barrier membrane is airtightly pressingly fixed to an upper side face of the bottom wall member 4 by an annular fixing plate 8. According to this configuration, the inner space of the pump body 1 is partitioned into a liquid chamber 9 inside the barrier membrane 7, and an air chamber 10 outside the barrier membrane 7.

The pump body 1 comprises a reciprocating driving device 22 which drives the barrier membrane 7 so as to expand and contract. The reciprocating driving device 22 is configured in the following manner. A cylinder 11 is formed on the side of the upper face of the upper wall 2 of the pump body 1 so that the axis of the cylinder coincides with the axis B of the barrier membrane 7. A piston 12 which is reciprocally moved in the cylinder 11 is coupled to a center area of a closed upper end portion 7*b* of the barrier membrane 7 through a piston rod 13 which is passed through the upper wall 2. Pressurized air which is fed from a pressurized air supplying device (not shown) such as a compressor is alternately supplied to the interior of the cylinder 11, and the air chamber 10 via air holes 14 and 15 formed in the cylinder 11 and the upper wall 2. Proximity sensors 16*a* and 16*b* are attached to the cylinder 11. By contrast, a sensor-sensible member 17 is attached to the piston 12. When the sensor-sensible member 17 is caused to approach alternately the proximity sensors 16*a* and 16*b* by the reciprocal motion of the piston 12, the supply of the pressurized air from the pressurized air supplying device into the cylinder 11, and that into the air chamber 10 are automatically alternately switched over. In accordance with the reciprocal motion of the piston 12, the barrier membrane 7 is driven to expand and contract.

A suction port 18 and a discharge port 19 are disposed in an inner wall 4*a* of the bottom wall member 4 of the pump body 1, the inner wall facing the liquid chamber 9. The suction and discharge ports 18 and 19 are disposed so as to respectively communicate with the outlet of the inflow path 5 and the inlet of the outflow path 6. A suction check valve 20 is disposed in the suction port 18, and a discharge check valve 21 is disposed in the outlet end of the outflow path 6.

An outlet portion 18*a* of the suction port 18 is opened so as to eject the sucked liquids toward a circumferential wall 9*a* of the liquid chamber 9 which is located in a direction different from the direction of the axis B, i.e., in the illustrated example, an inner peripheral wall of the barrier membrane 7 configured by a bellows.

Specifically, the outlet portion 18*a* of the suction port 18 is opened in a side face of a protruding forward end of the suction check valve 20 which is fixed to the bottom wall member 4 so as to protrude from the inner wall 4*a* into the liquid chamber 9. The suction check valve 20 is configured by a cylindrical valve casing 201 and upper and lower ball valve elements 202*a* and 202*b*. The valve casing 201 is fixed to the bottom wall member 4 with vertically directing its axis D, so as to communicate with the outlet side of the inflow path 5.

In this way, the outlet portion 18*a* of the suction port 18 is opened in the side face of the upper end of the valve casing 201. According to this configuration, the upper and lower ball valve elements 202*a* and 202*b* are caused by their own weights to be closely contacted with upper and lower valve seats 211 and 213 in the valve casing 201, respectively, thereby preventing the liquids supplied from the inflow path 5, from reversely flowing. When the liquids are to be sucked, the ball valve elements 202*a* and 202*b* are respectively upward separated from the valve seats 211 and 213, to open the valve, and the liquids supplied from the inflow path 5 are then ejected from the outlet portion 18*a* of the suction port 18 toward the circumferential wall 9*a* of the liquid chamber 9, with passing between the inner periphery of the valve casing 201 and the ball valve elements 202*a* and 202*b*.

Figure 2:
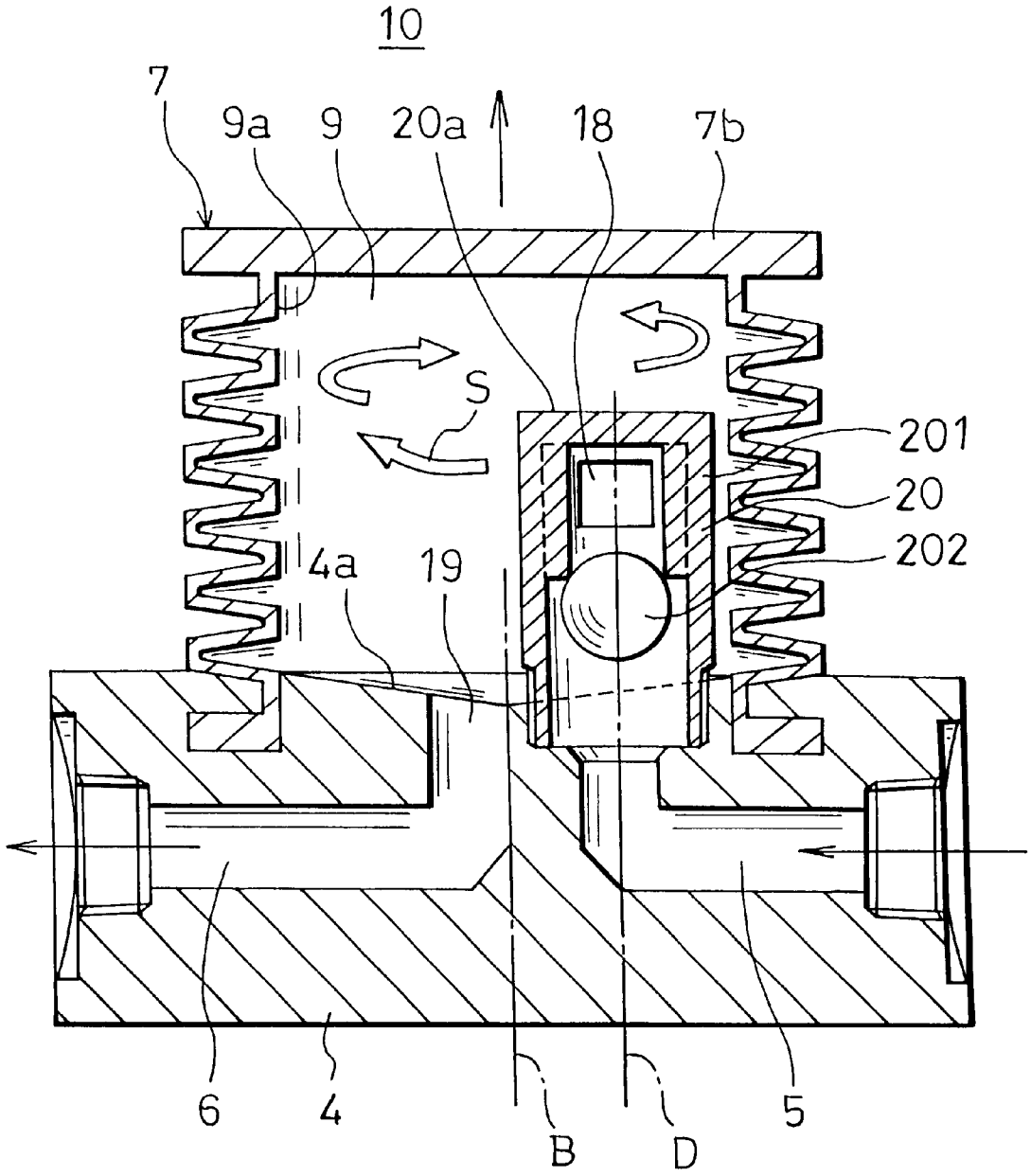
FIG. 2 is a section view showing a flowing state of liquids in a suction stroke of the reciprocating pump shown in FIG. 1.
Figure 3:
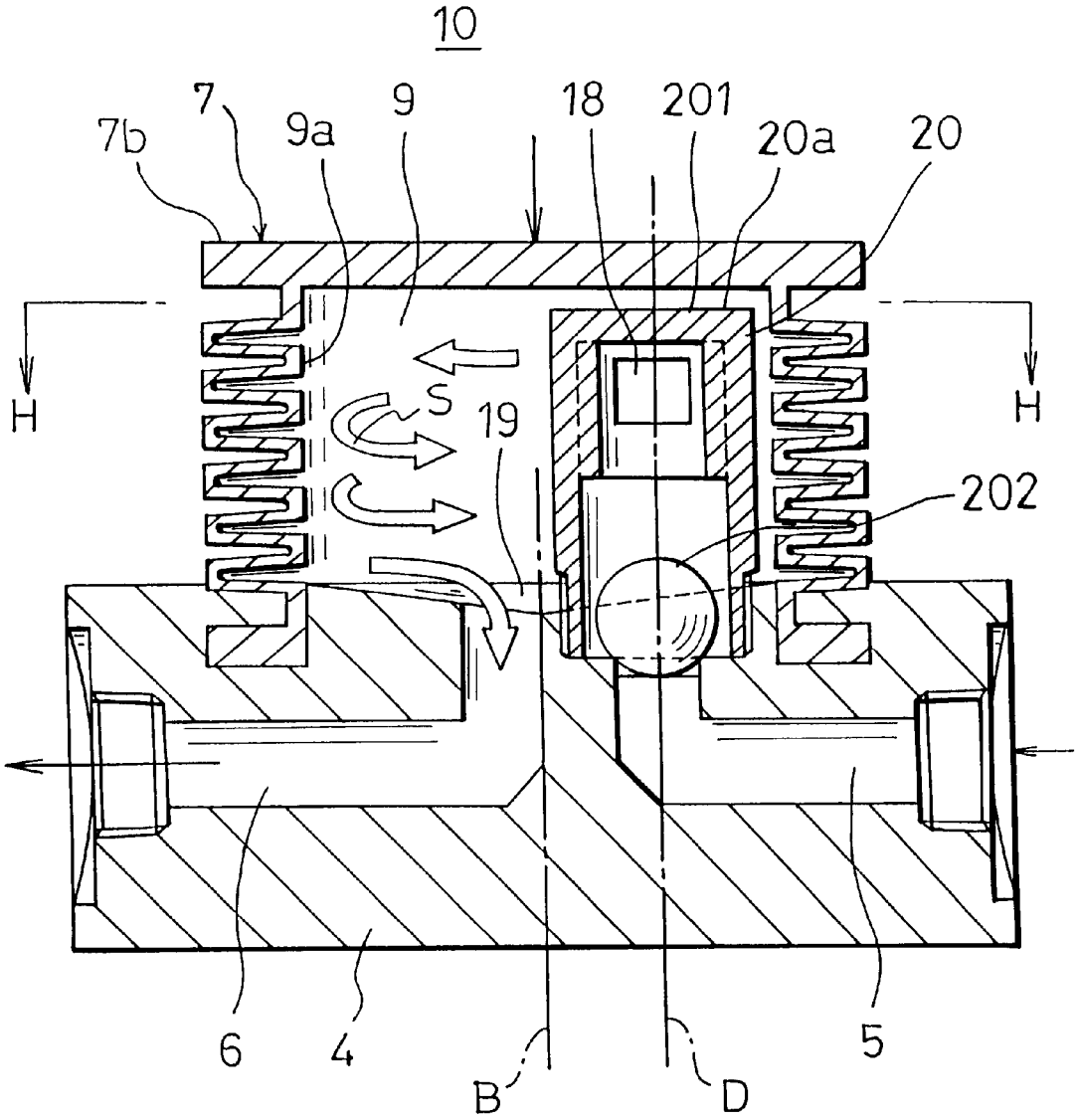
FIG. 3 is a section view showing a flowing state of liquids in a discharging stroke of the reciprocating pump shown in FIG. 1.
Figure 4:
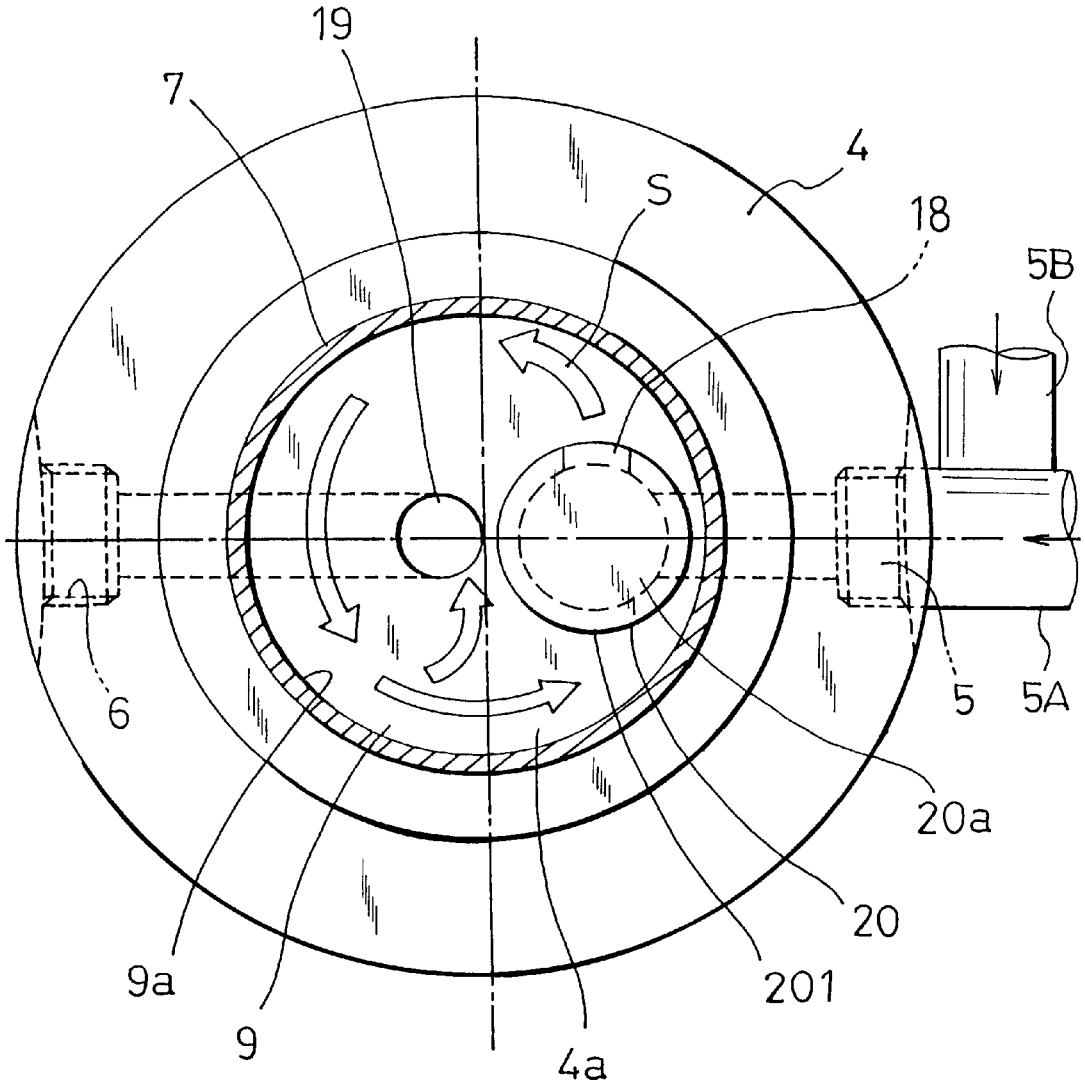
FIG. 4 is a section view taken along line H—H in FIG. 3.

At this time, since the outlet portion 18*a* of the suction port 18 is opened so as to eject the sucked liquids toward the circumferential wall 9*a* of the liquid chamber 9 which is located in a direction different from the direction of the axis B, the liquids ejected from the outlet portion 18*a* are circulated along the circumferential wall 9*a* of the liquid chamber 9 as indicating the flowing direction by the arrows S in FIGS. 2, 3, and 4. This circulating action causes the liquids to be uniformly stirred and mixed with each other in the liquid chamber 9. FIG. 2 shows the state of a suction stroke in which the barrier membrane 7 is expanded to suck the liquids, FIG. 3 shows the state of a discharging stroke in which the barrier membrane 7 is contracted to discharge the liquids, and FIG. 4 is a section view taken along line H—H in FIG. 3. FIGS. 2 and 3 show the suction check valve 20 in which only one valve element 202 is disposed in the valve casing 201.

In a conventional pump of this kind, the outlet portion of the suction port 18 is opened in an end face 20*a* of the protruding forward end of the suction check valve 20 so as to eject the sucked liquids into the liquid chamber 9 in a direction parallel to the direction of the axis B of the barrier membrane 7 (the direction of the reciprocal motion). Therefore, the liquids ejected from the outlet portion of the suction port 18 strike against the closed upper end portion 7*b* of the barrier membrane 7, and then flow as they are toward the discharge port 19. Consequently, the stirring action is hardly attained in the liquid chamber 9, so that the liquids cannot be sufficiently mixed with each other.

Next, the operation of the thus configured reciprocating pump will be described.

When pressurized air which is fed from the pressurized air supplying device (not shown) such as a compressor is supplied to the interior of the cylinder 11 via the air hole 14, the piston 12 is raised in the direction x in FIG. 1, and the barrier membrane 7 is expanded in the same direction, whereby the two or more different kinds of liquids which separately enter from the supply pipes 5A and 5B into the inflow path 5 are ejected from the outlet portion 18*a* of the suction port 18 toward the circumferential wall 9*a* of the liquid chamber 9, via the suction check valve 20. At this time, as described above, the sucked liquids which are ejected from the outlet portion 18*a* of the suction port 18 cause the circulating flow along the circumferential wall 9*a* of the liquid chamber 9, and are stirred in the liquid chamber 9 by this circulating action. Therefore, the two or more kinds of liquids which separately enter from the supply pipes 5A and 5B into the inflow path 5 can be stirred and mixed uniformly and rapidly with each other in the liquid chamber 9.

When the pressurized air is supplied into the air chamber 10 via the air hole 15 and then discharged from the air hole 14, the piston 12 is lowered in the direction y in FIG. 1, and the barrier membrane 7 is contracted in the same direction, whereby the mixed liquids in the liquid chamber 9 are discharged through the discharge port 19 while being circulated to be further stirred. When the barrier membrane 7 is reciprocally moved to expand and contract by the reciprocal motion of the piston 12 in the cylinder 11 in this way, the stroke of sucking from the suction port 18, and that of discharging to the discharge port 19 are alternately repeated to perform a predetermined reciprocating pumping action.

Figure 5:
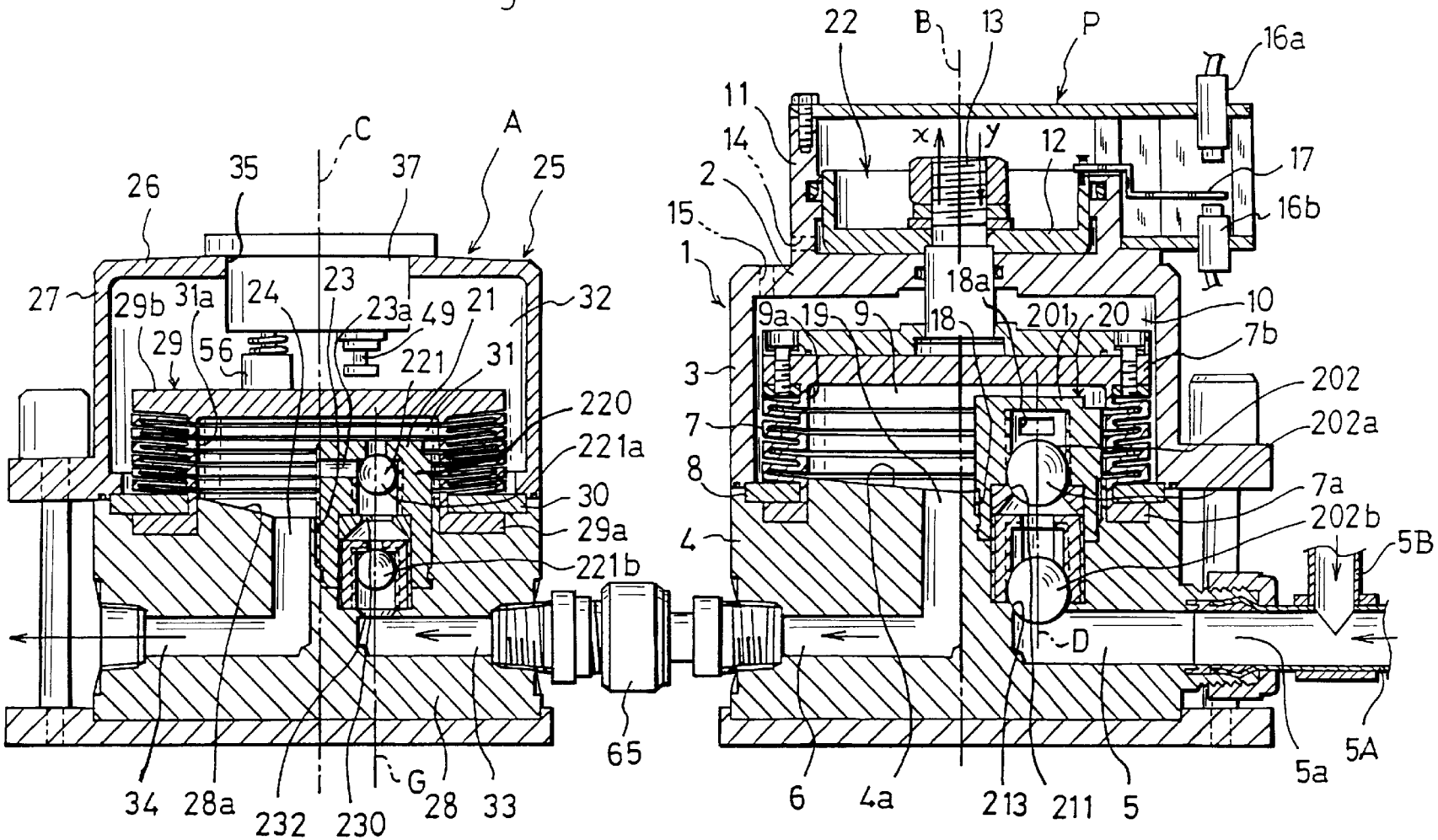
FIG. 5 is a longitudinal front section view of a reciprocating pump and an accumulator in a second embodiment of the invention.

FIG. 5 shows an embodiment in the case where the invention is applied to an accumulator A serving as a fluid apparatus for reducing pulsations of a reciprocating pump P.

The reciprocating pump P itself is structured in a substantially same manner as the reciprocating pump of FIG. 1. Therefore, identical components are denoted by the same reference numerals, and their description is omitted.

The body 25 of the accumulator A has a cylindrical casing 27 in which the upper end is closed by an upper wall 26, and a bottom wall member 28 which airtightly closes the open lower end of the casing 27.

A barrier membrane 29 configured by a bottomed cylindrical bellows which is expandingly and contractingly deformable in the direction of the axis C of the casing 27 is disposed in the casing, while vertically directing the axis C. An opening peripheral edge 29*a* of the lower end of the barrier membrane 29 is airtightly pressingly fixed to an upper side face of the bottom wall member 28 by an annular fixing plate 30. According to this configuration, the inner space of the accumulator body 25 is partitioned into a liquid chamber 31 inside the barrier membrane 29, and an air chamber 32 outside the barrier membrane 29.

A liquid inflow path 33 and a liquid outflow path 34 are formed in the bottom wall member 28 of the accumulator body 25. An inflow port 23 and an outflow port 24 are disposed in an inner wall 28*a* of the bottom wall member 28 facing the liquid chamber 31, so as to respectively communicate with the outlet of the inflow path 33 and the inlet of the outflow path 34. The inlet of the inflow path 33 is communicatingly pipe-connected to the outlet of the outflow path 6 of the above-mentioned reciprocating pump P through a coupling 65.

An outlet portion 23*a* of the inflow port 23 is opened so as to eject the inflow liquids toward a circumferential wall 31*a* of the liquid chamber 31 which is located in a direction different from the direction of the axis C, i.e., in the illustrated example, an inner peripheral wall of the barrier membrane 29 configured by a bellows.

Specifically, the outlet portion 23*a* of the inflow port 23 is opened in a side face of a protruding forward end of the discharge check valve 21 which is fixed to the bottom wall member 28 so as to protrude from the inner wall 28*a* into the liquid chamber 31. Namely, the discharge check valve 21 is structured in the same manner as the suction check valve 20 described above. The discharge check valve 21 is configured by a cylindrical valve casing 220 and upper and lower ball valve elements 221*a* and 221*b*. The valve casing 220 is fixed to the bottom wall member 28 with vertically directing its axis G.

In this way, the outlet portion 23*a* of the inflow port 23 is opened in the side face of the upper end of the valve casing 220. According to this configuration, the upper and lower ball valve elements 221*a* and 221*b* are caused by their own weights to be closely contacted with upper and lower valve seats 230 and 232 in the valve casing 220, respectively, thereby preventing the mixed liquids from reversely flowing in the outflow path 6 of the reciprocating pump P. When the mixed liquids are to be discharged to the liquid chamber 31, the ball valve elements 221*a* and 221*b* are respectively upward separated from the valve seats 230 and 232, to open the valve, and the mixed liquids supplied from the reciprocating pump P are then ejected from the outlet portion 23*a* of the inflow port 23 of the valve casing 220 toward the circumferential wall 31*a* of the liquid chamber 31, with passing between the inner periphery of the valve casing 220 and the ball valve elements 221*a* and 221*b*.

At this time, since the outlet portion 23*a* of the inflow port 23 is opened so as to eject the inflow liquids toward the circumferential wall 31*a* of the liquid chamber 31 which is located in a direction different from the direction of the axis C, the mixed liquids ejected from the inflow port 23 are circulated along the circumferential wall 31*a* of the liquid chamber 31. This circulating action causes the liquids to be further stirred in the liquid chamber 31.

Figure 6:
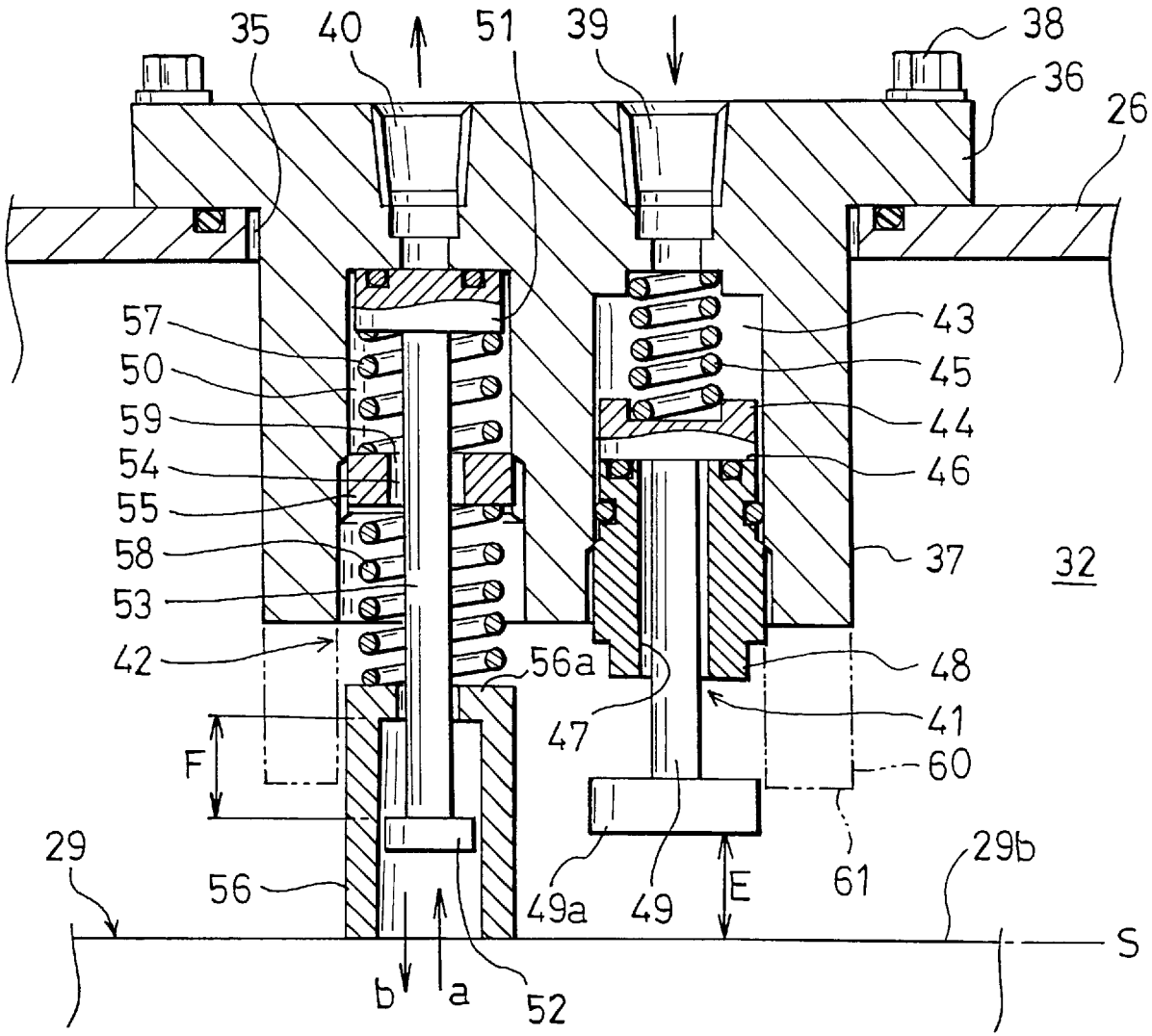
FIG. 6 is an enlarged longitudinal front section view of an automatic pressure regulating mechanism of the accumulator shown in FIG. 5.

As shown in FIG. 6, an air inlet/outlet port 35 is formed in the vicinity of the center area of the outer face of the upper wall 26 of the casing 27 of the accumulator A. A valve case 37 having a flange 36 is fitted into the air inlet/outlet port 35. The flange 36 is detachably fastened and fixed to the outside of the upper wall 26 by bolts 38, etc.

In the valve case 37, an air supply port 39 and an air discharge port 40 are juxtaposed in parallel with each other. An automatic air supply valve mechanism 41 is disposed in the air supply port 39. When the capacity of the liquid chamber 31 is increased to exceed a predetermined range, the automatic air supply valve mechanism supplies air of a pressure which is higher than the maximum pressure of the transported liquids, into the air chamber 32, thereby raising the filling pressure in the air chamber 32. An automatic air discharge valve mechanism 42 is disposed in the air discharge port 40. When the capacity of the liquid chamber 31 is reduced to exceed the predetermined range, the automatic air discharge valve mechanism discharges air from the air chamber 32, thereby lowering the filling pressure in the air chamber 32.

Next, the reciprocating pump P and the accumulator A which are configured as described above will be described.

When pressurized air which is fed from the pressurized air supplying device (not shown) such as a compressor is supplied to the interior of the cylinder 11 via the air hole 14, the piston 12 is raised in the direction x in FIG. 1, and the barrier membrane 7 is expanded in the same direction, whereby the two or more different kinds of liquids which separately enter from the supply pipes 5A and 5B into the inflow path 5 are ejected from the outlet portion 18*a* of the suction port 18 toward the circumferential wall 9*a* of the liquid chamber 9, via the suction check valve 20. At this time, the sucked liquids which are ejected from the outlet portion 18*a* of the suction port 18 cause the circulating flow along the circumferential wall 9*a* of the liquid chamber 9, and are stirred in the liquid chamber 9 by this circulating action. Therefore, the two or more kinds of liquids which separately enter from the supply pipes 5A and 5B into the inflow path 5 can be stirred and mixed uniformly and rapidly with each other in the liquid chamber 9.

When the pressurized air is supplied into the air chamber 10 via the air hole 15 and then discharged from the air hole 14, the piston 12 is lowered in the direction y in FIG. 1, and the barrier membrane 7 is contracted in the same direction, whereby the mixed liquids in the liquid chamber 9 are discharged through the discharge port 19 while being circulated to be further stirred. When the barrier membrane 7 is reciprocally moved to expand and contract by the reciprocal motion of the piston 12 in the cylinder 11 in this way, the stroke of sucking from the suction port 18, and that of discharging to the discharge port 19 are alternately repeated to perform a predetermined reciprocating pumping action. When the mixed liquids are supplied to a given place by the operation of the reciprocating pump P, the discharge pressure of the reciprocating pump generates pulsations due to repetition of peak and valley portions.

The mixed liquids which are discharged from the liquid chamber 9 of the reciprocating pump P through the discharge port 19 and the outflow path 6 are ejected from the outlet portion 23*a* of the inflow port 23 of the discharge check valve 21 toward the circumferential wall 31*a* of the liquid chamber 31, through the inflow paths 33 of the accumulator A, and then temporarily stored in the liquid chamber 31. Thereafter, the liquids flow out from the outflow port 24 into the outflow path 34. In this case, when the discharge pressure of the transported mixed liquids is in a peak portion of the discharge pressure curve, the transported mixed liquids cause the barrier membrane 29 to be expandingly deformed so as to increase the capacity of the liquid chamber 31, and hence the pressure is absorbed. At this time, the flow quantity of the transported mixed liquids flowing out from the liquid chamber 31 is smaller than that of the liquids supplied from the reciprocating pump P.

As described above, the transported mixed liquids supplied from the outlet portion 23*a* of the inflow port 23 are ejected toward the circumferential wall 31*a* of the liquid chamber 31, and the mixed liquids therefore generate the circulating flow along the circumferential wall 31*a* of the liquid chamber 31. This circulating action causes the liquids to be again stirred in the liquid chamber 31. Consequently, the transported mixed liquids from the outflow path 6 of the reciprocating pump P are circulated in the liquid chamber 31 while being stirred further uniformly.

By contrast, when the discharge pressure of the transported mixed liquids comes to a valley portion of the discharge pressure curve, the pressure of the transported mixed liquids becomes lower than the air pressure of the air chamber 32 which is compressed by extension of the barrier membrane 29 of the accumulator A, and hence the barrier membrane 29 is contractingly deformed. At this time, the flow quantity of the transported mixed liquids flowing out from the liquid chamber 31 is larger than that of the transported mixed liquids flowing from the reciprocating pump P into the liquid chamber 31. This repeated operation, i.e., the capacity change of the liquid chamber 31 causes the pulsations to be absorbed and suppressed.

By contrast, when the discharge pressure of the reciprocating pump P is varied in the decreasing direction, the capacity of the liquid chamber 31 is reduced by the transported mixed liquids, with the result that the barrier membrane 29 is largely contractingly deformed. When the degree of contracting deformation of the barrier membrane 29 exceeds a predetermined range F, a slider 56 of the automatic air discharge valve mechanism 42 is moved in the contraction direction b of the barrier membrane 29 by the urging function exerted by an opening spring 58, in accordance with the movement of a closed upper end portion 29*b* of the barrier membrane 29, and the inner face of a closed end portion 56*a* of the slider 56 is engaged with a flange 52 of an air discharge valve rod 53. This causes the air discharge valve rod 53 to be moved in the direction b, and the discharge valve element 51 opens the air discharge port 40. As a result, the filled air in the air chamber 32 is discharged to the atmosphere through the air discharge port 40, and the filling pressure of the air chamber 32 is lowered. Therefore, the amount of contracting deformation of the barrier membrane 29 is restricted so as not to exceed the stroke F, whereby the capacity of the liquid chamber 31 is suppressed from being excessively reduced. In accordance with the reduction of the filling pressure in the air chamber 32, the barrier membrane 29 is extended toward a reference position S. Therefore, the slider 56 is pushed by the closed upper end portion 29*b* of the barrier membrane 29, to compress an opening spring 58 while moving in the direction a. The discharge valve element 51 again closes the air discharge port 40 by the urging function of the closing spring 57, whereby the filling pressure in the air chamber 32 is fixed to the adjusted state. As a result, pulsations are efficiently absorbed and the amplitude of pulsations is suppressed to a low level, irrespective of variation of the discharge pressure from the liquid chamber 9 of the reciprocating pump P.

Figure 7:
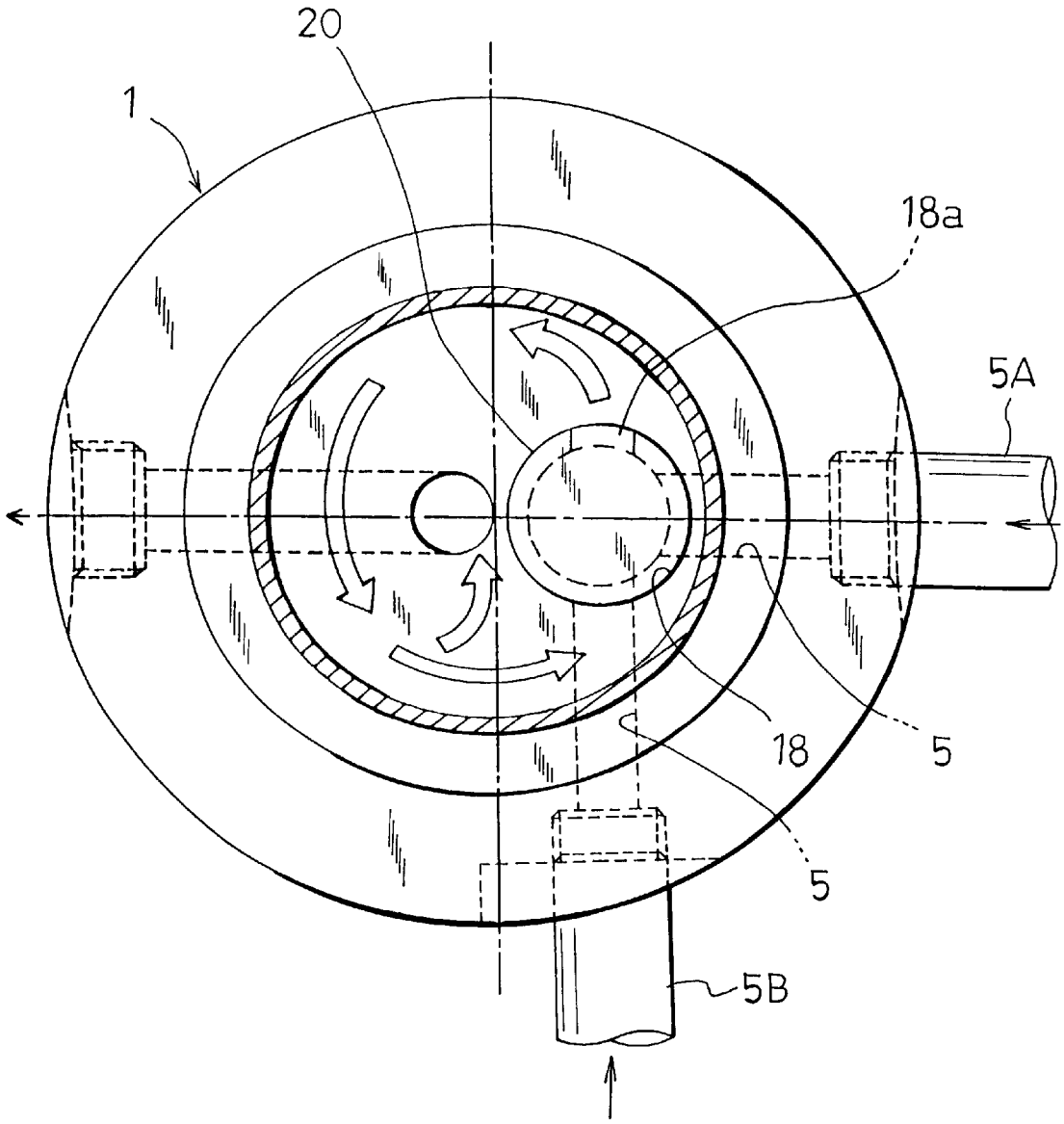
FIG. 7 is a section view showing a reciprocating pump in a third embodiment of the invention in correspondence with FIG. 4.

FIG. 7 shows another embodiment. In this embodiment, inflow paths 5 respectively for two or more kinds of liquids are individually disposed in the pump body 1, outlets of the inflow paths 5 are communicatingly formed in the inlet portion of the single suction port 18 so as to join together in the inlet portion, and supply pipes 5A and 5B for the liquids are connected to the inlet portions of the inflow paths 5, respectively. This configuration is different from the embodiment shown in FIGS. 1 to 4 in which the supply pipes 5A and 5B respectively for the liquids are connected to the inlet portion of the single inflow path 5 so as to join together. The other configuration is identical with that of the first embodiment. Therefore, identical components are denoted by the same reference numerals, and their description is omitted.

In the accumulator A of FIG. 5, the supply pipes 5A and 5B respectively for the plural kinds of liquids are pipe-connected through the reciprocating pump P to the inlet portion of the liquid inflow path 33 so as to join together. Alternatively, the supply pipes 5A and 5B respectively for the plural kinds of liquids may be directly pipe-connected to the inlet portion of the liquid inflow path 33 of the accumulator body 25 so as to join together.

Figure 8:
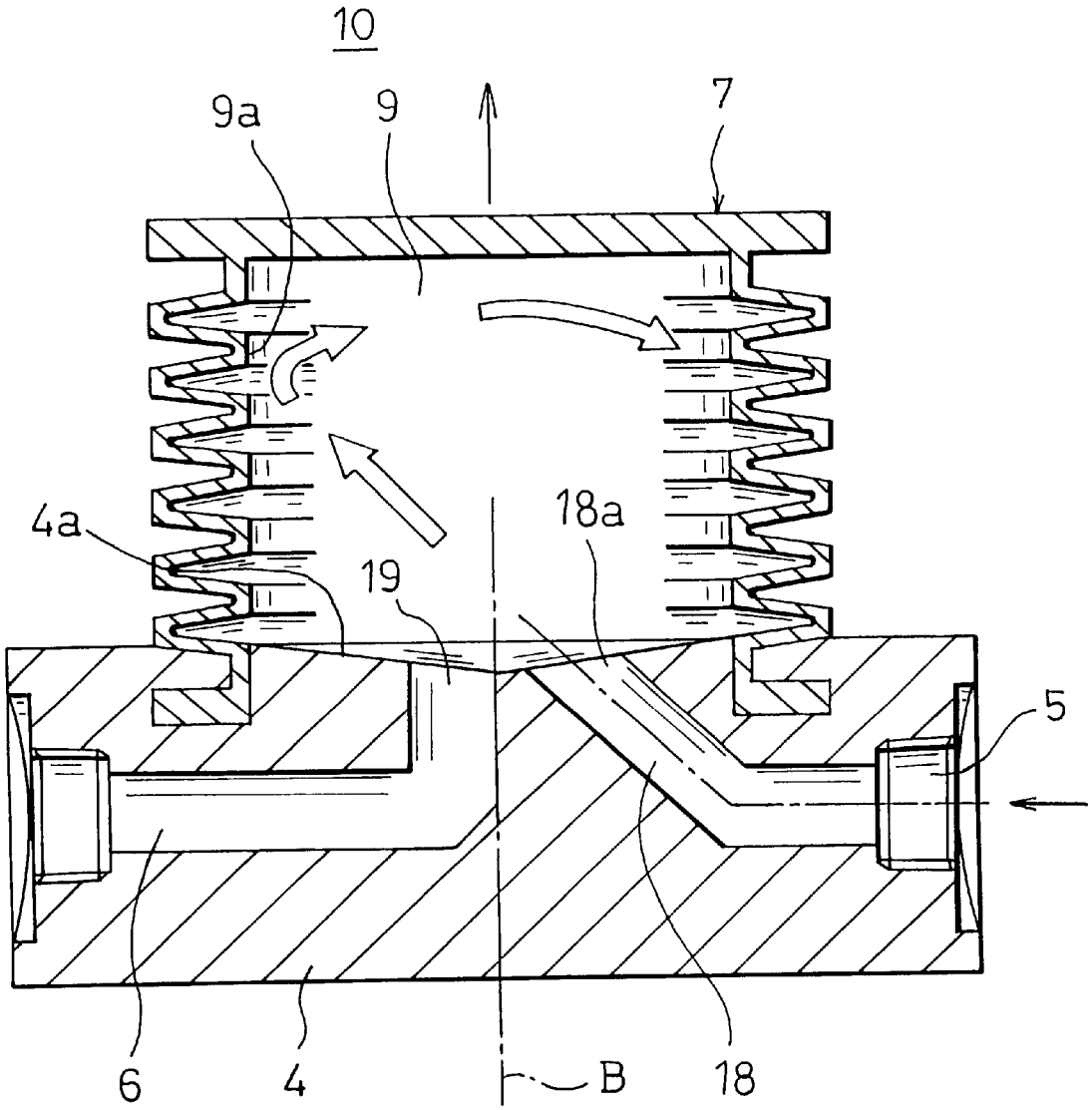
FIG. 8 is a longitudinal front section view of main portions of a reciprocating pump in a fourth embodiment of the invention.

In the above embodiments, the outlet portion 18*a* of the suction port 18 of the reciprocating pump P is opened in the side face of the protruding forward end of the suction check valve 20. Alternatively, as shown in FIG. 8, the outlet portion 18*a* of the suction port 18 may be obliquely upward opened in the inner wall 4*a* itself of the pump body 1 so as to eject the liquids toward the circumferential wall 9*a* of the liquid chamber 9. In the accumulator A also, in place of the formation in the side face of the protruding forward end of the discharge check valve 21, the outlet portion 23*a* of the inflow port 23 may be obliquely upward opened in the inner wall 28*a* itself of the accumulator body 25 so as to eject the liquids toward the circumferential wall 31*a* of the liquid chamber 31.

In the accumulator A of the embodiment described above, the automatic pressure regulating mechanism consisting of the automatic air supply valve mechanism 41 and the automatic air discharge valve mechanism 42 is disposed on the air chamber 32. The automatic pressure regulating mechanism may be configured in the manner shown in FIGS. 9 to 16.

Figure 9:
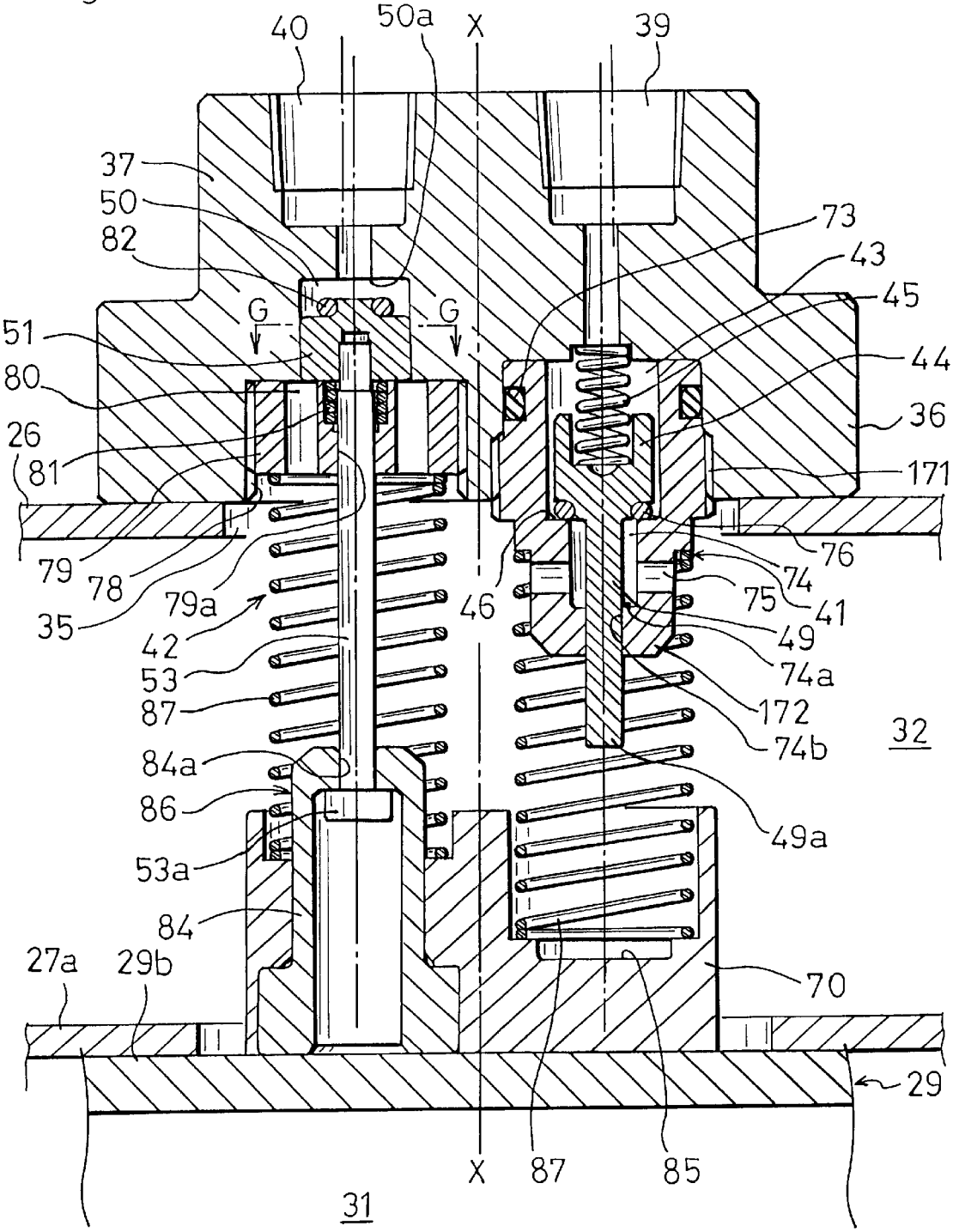
FIG. 9 is an enlarged longitudinal front section view showing another modification of the automatic pressure regulating mechanism of the accumulator.

In the automatic pressure regulating mechanism, as shown in FIG. 9, an opening 35 is formed in the vicinity of the center area of the upper wall 26 of the casing 27 of the accumulator A. A valve case 37 into which an air supply/discharge valve is incorporated is fitted into the opening 35. A flange 36 which is attached to an outer periphery of the rear end of the valve case 37 is detachably fastened and fixed to the upper wall 26 by bolts, etc. On the other hand, a control disk 70 of the air supply/discharge valve is abuttingly placed in a center area of the closed upper end portion 29*b* of the barrier membrane 29 facing the air chamber 32, so as to be opposed to the valve case 37.

Figure 10:
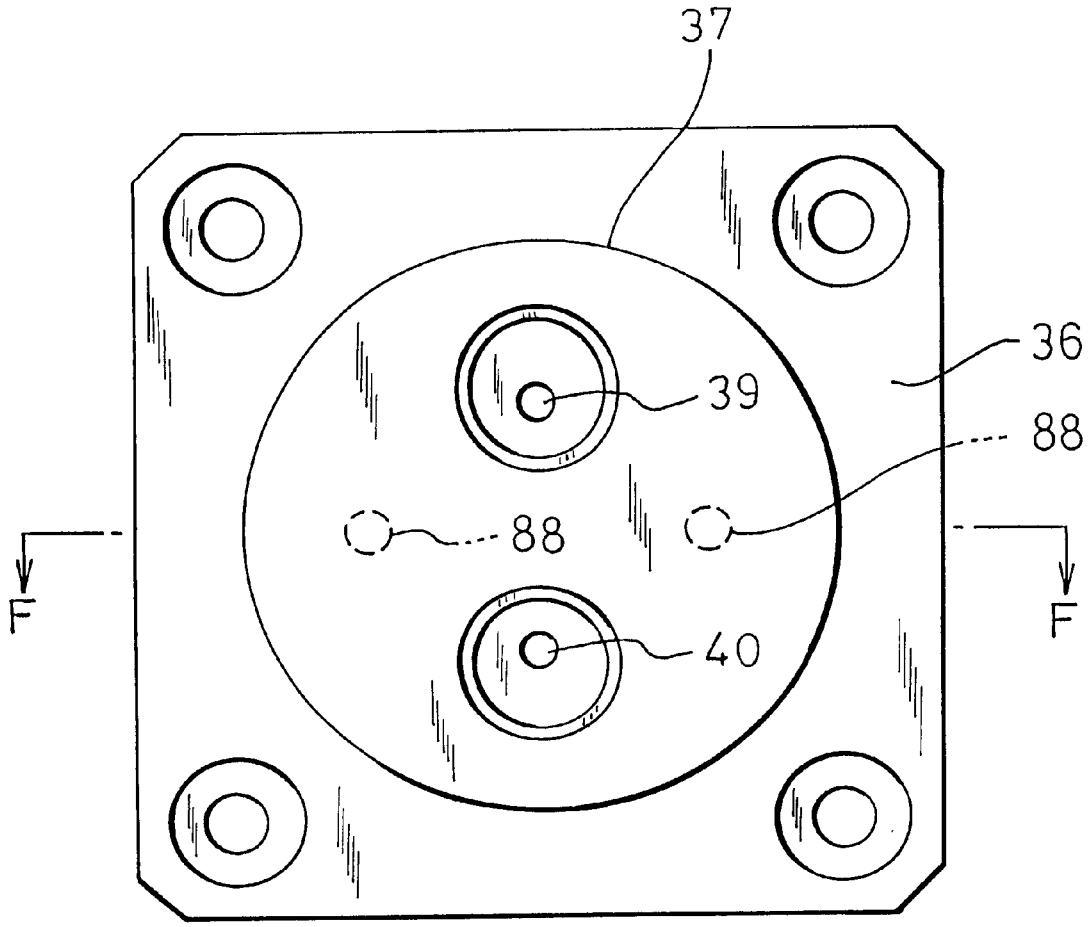
FIG. 10 is a plan view of the automatic pressure regulating mechanism shown in FIG. 9.

As shown in FIG. 10, an air supply port 39 and an air discharge port 40 are juxtaposed in the front end face of the valve case 37. An automatic air supply valve mechanism 41 is disposed in the air supply port 39. When the capacity of the liquid chamber 31 is increased to exceed a predetermined range, the automatic air supply valve mechanism supplies air of a pressure which is higher than the maximum pressure of the transported liquids, into the air chamber 32, thereby raising the filling pressure in the air chamber 32. An automatic air discharge valve mechanism 42 is disposed in the air discharge port 40. When the capacity of the liquid chamber 31 is reduced to exceed the predetermined range, the automatic air discharge valve mechanism discharges air from the air chamber 32, thereby lowering the filling pressure in the air chamber 32.

In the automatic air supply valve mechanism 41, as shown in FIG. 9, an internal threaded portion 171 is formed in the rear end face of the valve case 37 so as to communicate with the air supply port 39, and an air supply valve holder 172 which holds an air supply valve element 44 and a valve rod 49 that is integral with the valve element is screwingly fixed to the internal threaded portion 171 via an O-ring 73. In the air supply valve holder 172, an air supply valve chamber 43 is formed in a front side end portion which is screwed into the internal threaded portion 171, a valve seat 46 is formed in the inner bottom of the air supply valve chamber 43, and a valve rod passing hole 74 is formed in the rear end portion so as to coaxially communicate with the air supply valve chamber 43. A plurality of communication holes 75 through which the air supply valve chamber 43 communicates with the air chamber 32 via the valve rod passing hole 74 are formed in the outer periphery of the rear end portion of the air supply valve holder 172. The formation of the communication holes 75 improves the responsibility to a pressure change in the air chamber 32.

In the air supply valve holder 172, an air supply valve 36 is incorporated into the air supply valve chamber 43 so as to be movable in the axial direction, and the valve rod 49 is passed through the valve rod passing hole 74. A rear end portion of the valve rod 49 protrudes into the rear of the air supply valve holder 172. The valve rod passing hole 74 is formed into a stepped shape having: a larger diameter hole portion 74*a* in which the inner diameter is larger than the outer diameter of the valve rod 49 to form a communication gap between the hole portion and the valve rod 49; and a guide hole portion 74*b* which is slightly larger than the outer diameter of the valve rod 49 and slidingly contacted with the valve rod 49 without leaving a gap therebetween. When the valve rod 49 is slidingly guided by the guide hole portion 74*b*, the valve element 44 can be straightly moved in the air supply valve chamber 43 along the axial direction of the chamber.

Figure 12:
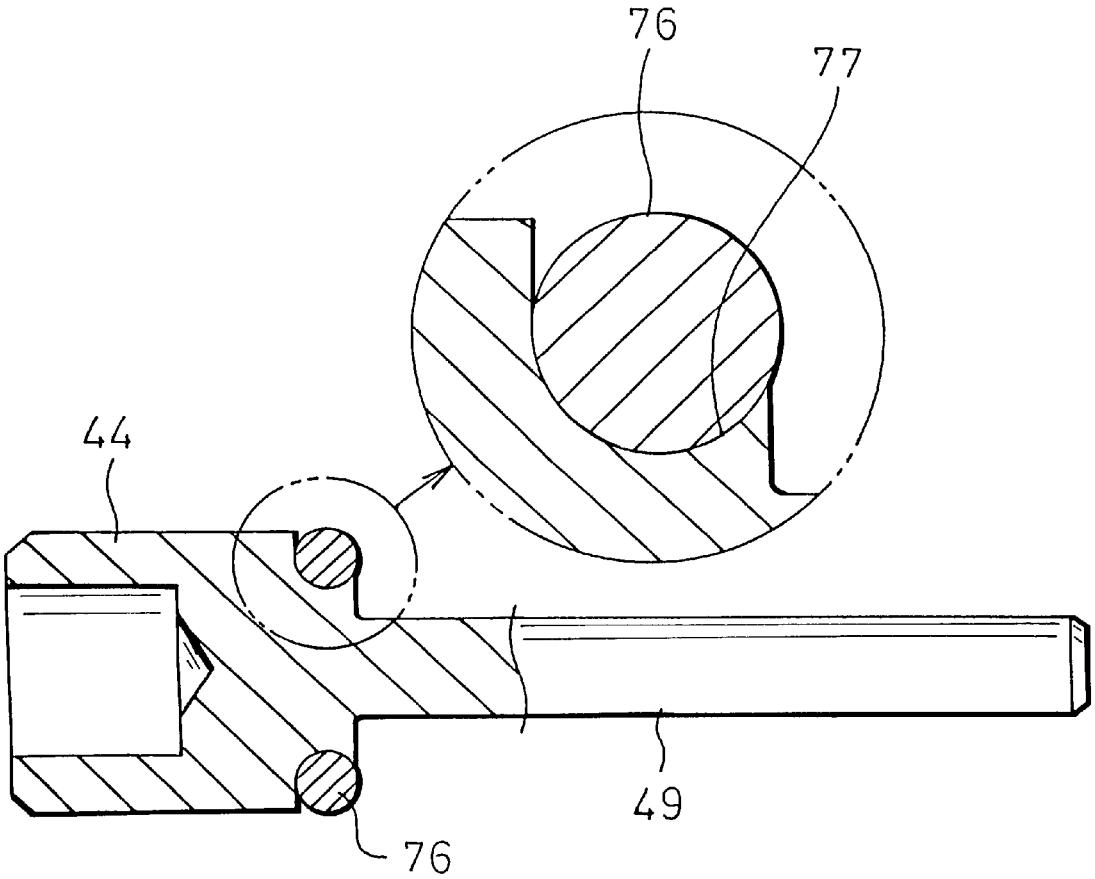
FIG. 12 is a section view of an air supply valve of the automatic pressure regulating mechanism shown in FIG. 9.
Figure 13:
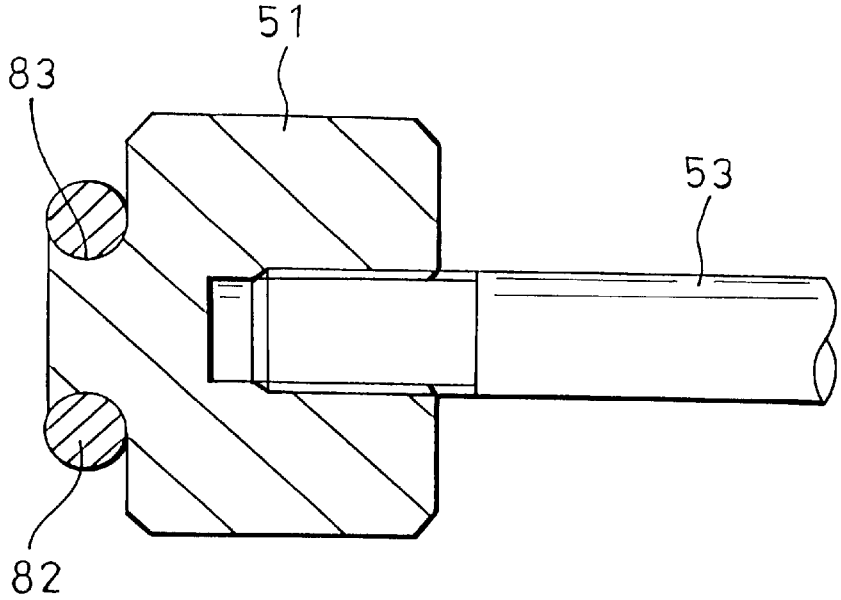
FIG. 13 is a section view of an air discharge valve of the automatic pressure regulating mechanism shown in FIG. 9.

In the air supply valve chamber 43, the supply valve element 44 is always urged by a spring 45 so as to be in the closing position where the element is closely contacted with the valve seat 46. The supply valve element 44 is airtightly contacted with the valve seat 46 via an O-ring 76. As shown in FIG. 12, the O-ring 76 is fitted into an arcuate groove 77 formed in a corner portion of the rear end face of the valve element 44, whereby the O-ring is lockedly attached to the valve element.

In a state where the liquid pressure in the liquid chamber 31 is at an average pressure and the barrier membrane 29 is in a reference position, the supply valve element 44 is closely contacted with the valve seat 46 of the valve holder 172 to close the air supply port 39, and an end portion 49*a* of the valve rod 49 facing the interior of the air chamber 32 is separated from the closed upper end portion 29*b* of the barrier membrane 29 by a predetermined stroke.

Figure 14:
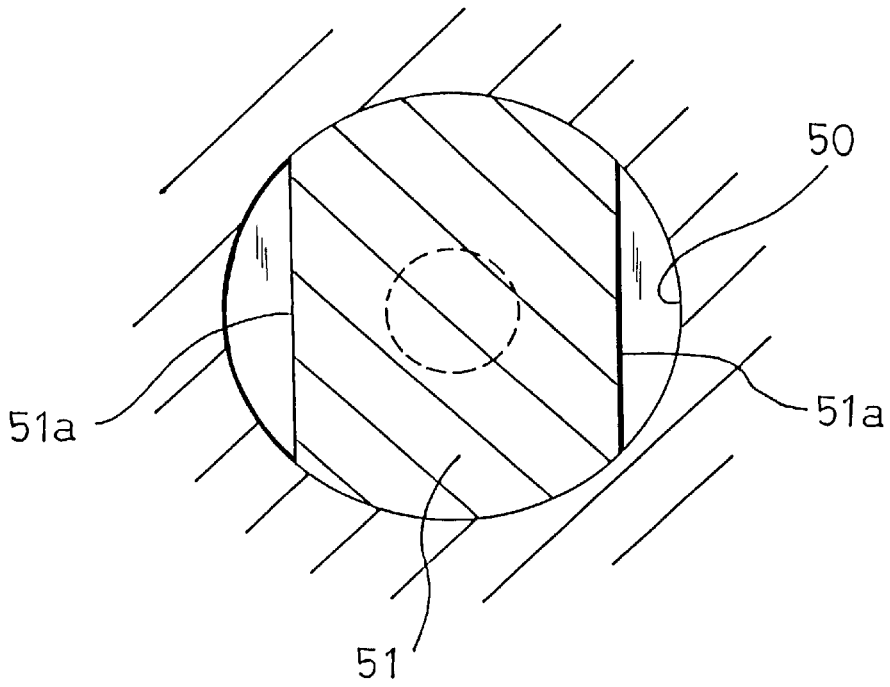
FIG. 14 is a section view taken along line G—G in FIG. 9.

On the other hand, in the automatic air discharge valve mechanism 42, as shown in FIG. 9, a discharge valve chamber 50 having a circular section shape, and an internal threaded portion 78 having an inner diameter which is larger than that of the discharge valve chamber 50 are formed in the rear end face of the valve case 37 so as to coaxially communicate with the air discharge port 40. The discharge valve element 51 having a shape in which flat faces 51*a* are formed in opposing portions on the circumference as shown in FIG. 14 is incorporated in the discharge valve chamber 50 so as to be movable along the axial direction. The air discharge valve rod 53 is integrally coupled to the discharge valve element 51. The air discharge valve rod 53 is passed through and held by a valve rod guide hole portion 79*a* so as to be slidable in the axial direction. The valve rod guide hole portion 79*a* is in the center of a discharge valve rod holder 79 which is screwingly fixed to the internal threaded portion 78. In the discharge valve rod holder 79, a plurality of communication holes 80 through which the discharge valve chamber 50 communicates with the air chamber 32 are formed on the same circle that is centered at the valve rod guide hole portion 79*a*. A spring 81 through which the air discharge valve rod 53 is passed is interposed between the discharge valve element 51 and the discharge valve rod holder 79. The discharge valve element 51 is always urged by the spring 81 so as to be in the closing position where the element is closely contacted with the valve seat 50*a* of the discharge valve chamber 50. The discharge valve element 51 is airtightly contacted with the valve seat 50*a* via an O-ring 82. As shown in FIG. 14, the O-ring 82 is fitted into an arcuate groove 83 formed in a corner portion of the front end face of the discharge valve element 51, whereby the O-ring is lockedly attached to the valve element.

In a state where the barrier membrane 29 is in the reference position, the discharge valve element 51 closes the air discharge port 40, and a flange 53*a* in the rear end of the air discharge valve rod 53 is separated from the inner face of a closed end portion 84*a* of a sleeve 84 by a predetermined stroke.

On the other hand, the air supply/discharge valve control disk 70 which is abuttingly placed in the center area of the closed upper end portion 29*b* of the barrier membrane 29 is formed into a disk-like shape, an air supply valve rod pressing portion 85 is recessed in the front face of the element, and the sleeve 84 constituting a discharge valve rod pulling portion 86 is fittingly fixed in juxtaposition with the air supply valve rod pressing portion 85. A guide hole portion 84*a* which is slightly larger than the outer diameter of the air discharge valve rod 53 and slidingly contacted with the valve rod 53 without leaving a gap therebetween is formed in a front end portion of the sleeve 84. The rear end portion of the air discharge valve rod 53 having the flange 53*a* is passed through and coupled to the guide hole portion 84*a* in a slidable and slipping-off preventing manner. When the air discharge valve rod 53 is slidingly guided by the guide hole portion 84*a*, the air discharge valve rod 53 can be straightly moved along the axial direction. The sleeve 84 may be formed integrally with the air supply/discharge valve control disk 70.

Springs 87 each consisting of a compression spring are interposed between the air supply valve rod pressing portion 85 of the air supply/discharge valve control disk 70 and the rear end portion of the air supply valve holder 172, and the sleeve 84 and the rear end face of the discharge valve rod holder 79, so as to surround the outer peripheries of the air supply valve rod 49 and the air discharge valve rod 53, respectively. The air supply/discharge valve control disk 70 is urged by the springs 87 to be pressed toward the center area of the closed upper end portion 29*b* of the barrier membrane 29.

Figure 11:
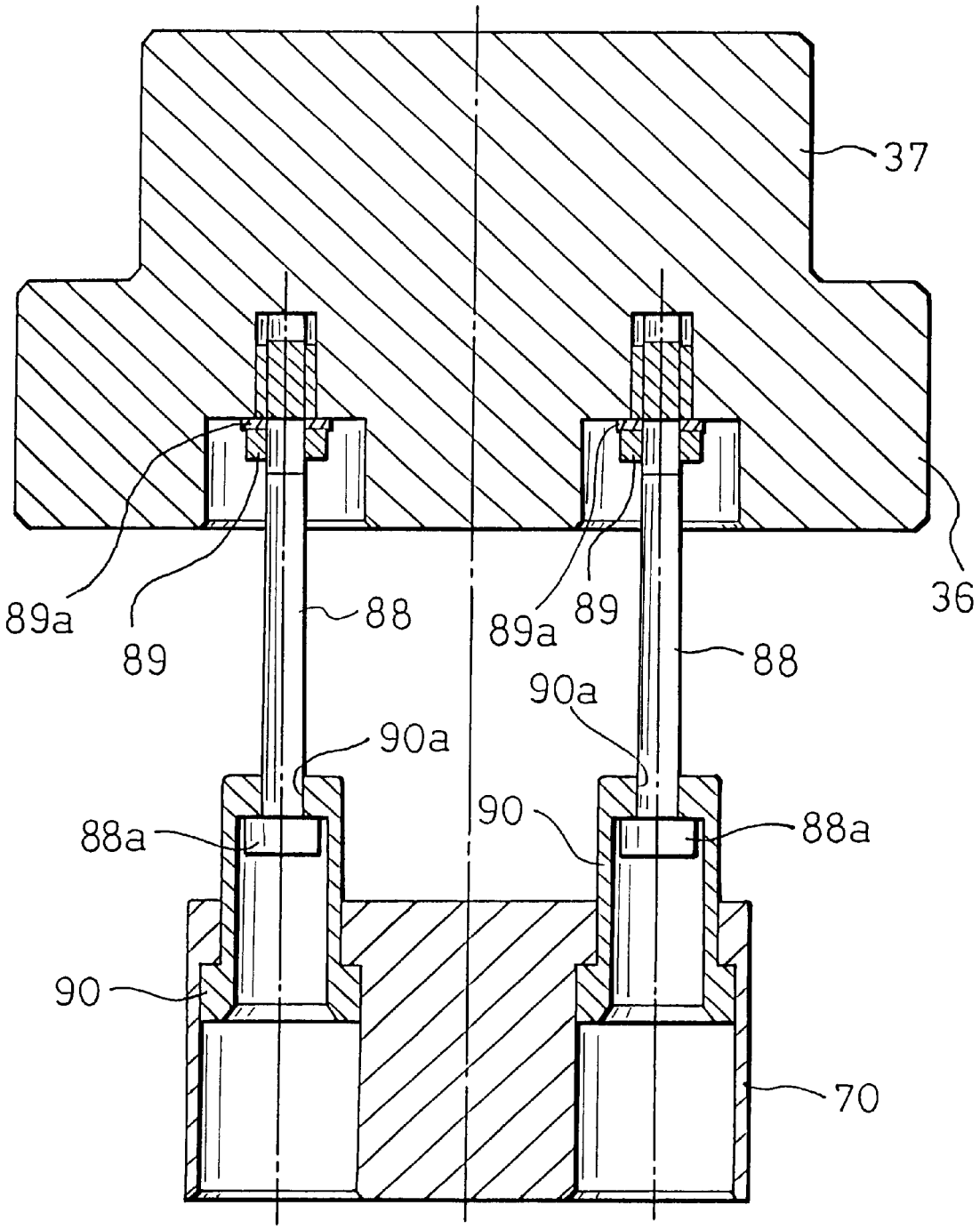
FIG. 11 is a section view taken along line F—F in FIG. 10.

As shown in FIG. 11, the air supply/discharge valve control disk 70 and the valve case 37 are coupled to each other by one, or preferably plural guide shafts 88 which are parallel to the expanding and contracting directions of the barrier membrane 29. In each of the guide shafts 88, the front end portion is fasteningly fixed to the rear end face of the valve case 37 by a nut 89 via a washer 89*a*, and the rear end portion having a flange 88*a* is coupled to a guide sleeve 90 which is embeddedly fixed to the front end face of the air supply/discharge valve control disk 70, so as to be prevented from slipping off, and slidable in the axial direction. In the front end portion of each of the guide sleeves 90, a guide hole portion 90*a* which is slidingly contacted with the corresponding guide shaft 88 without leaving a gap therebetween is formed. The rear end portions of the guide shafts 88 are passed through the guide hole portions 90*a*, thereby enabling the air supply/discharge valve control disk 70 to be straightly moved in parallel with the expanding and contracting directions of the barrier membrane 29 under guidance of the guide shafts 88.

The guide sleeves 90 may be formed integrally with the air supply/discharge valve control disk 70.

Next, the operation of the thus configured automatic air supply/discharge valve mechanisms 41 and 42 will be described.

Figure 15A:
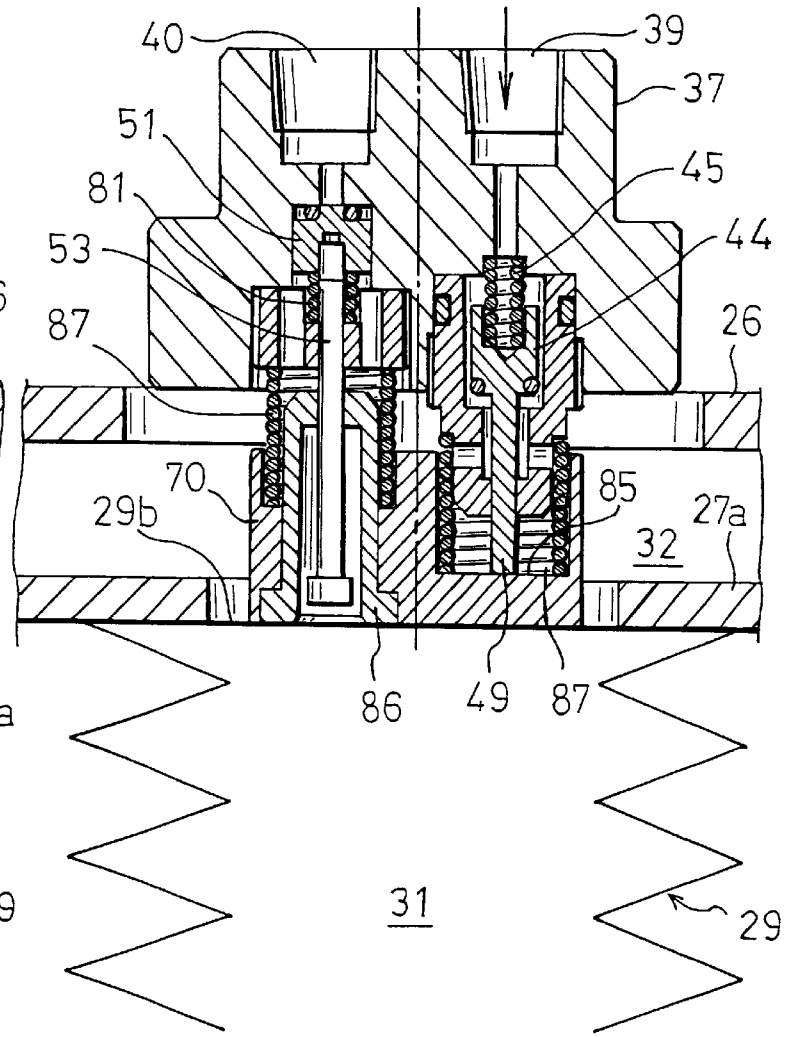
FIG. 15A is a view showing operations of the air supply valve and the air discharge valve of the automatic pressure regulating mechanism in the case where the fluid pressure in a bellows of the accumulator is raised.
Figure 15B:
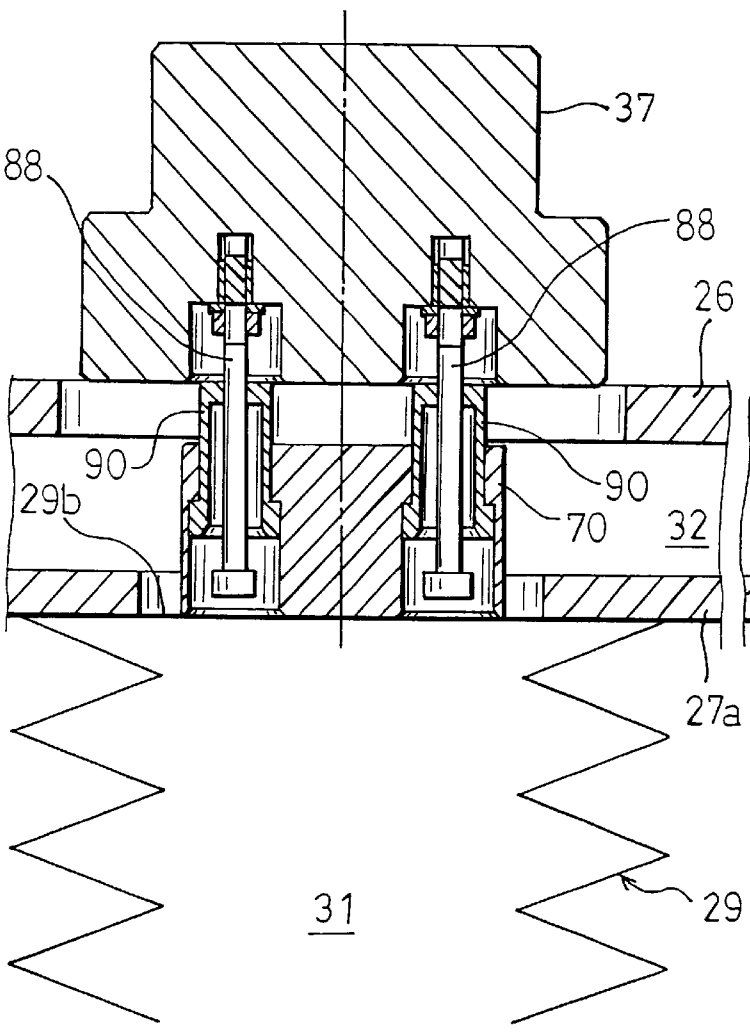
FIG. 15B is a view showing operations of a guide shaft and a guide sleeve of the automatic pressure regulating mechanism in the case where the fluid pressure in the bellows of the accumulator is raised.

When the discharge pressure of the reciprocating pump P is raised, the capacity of the liquid chamber 31 is increased by the transported liquids, and the fluid pressure in the liquid chamber 31 overcomes the pressure in the air chamber 32, with the result that the barrier membrane 29 is expandingly deformed. As shown in FIGS. 15A and 15B, this expanding deformation of the barrier membrane 29 causes the air supply/discharge valve control disk 70 to be pushed by the center area of the closed upper end portion 29*b* of the barrier membrane 29 toward the valve case 37. As a result, the rear end portion of the air supply valve rod 49 is pushed by the air supply valve rod pressing portion 85 of the air supply/discharge valve control disk 70, whereby the air supply valve element 44 which has been set to the closing state by the spring 45 is changed to the opening state. Therefore, the compressed air is supplied into the air chamber 32 through the air supply port 39 to raise the filling pressure in the air chamber 32. In accordance with the rise of the filling pressure in the air chamber 32, the barrier membrane 29 is contracted. Then, the air supply valve rod pressing portion 85 of the air supply/discharge valve control disk 70 does not push the rear end portion of the air supply valve rod 49, and the air supply valve element 44 is set to the closing state by the spring 45 and the compressed air in the air chamber 32, so as to balance with the fluid pressure in the liquid chamber 31. When the barrier membrane 29 is expanded by a degree which is greater than the predetermined stroke, the closed upper end portion 29*b* of the membrane strikes against a stopper wall 27*a* of the casing 27 of the accumulator A which protrudes into the air chamber 32, whereby excessive expanding deformation of the barrier membrane 29 is restricted, so that the barrier membrane can be prevented from being damaged.

Figure 16A:
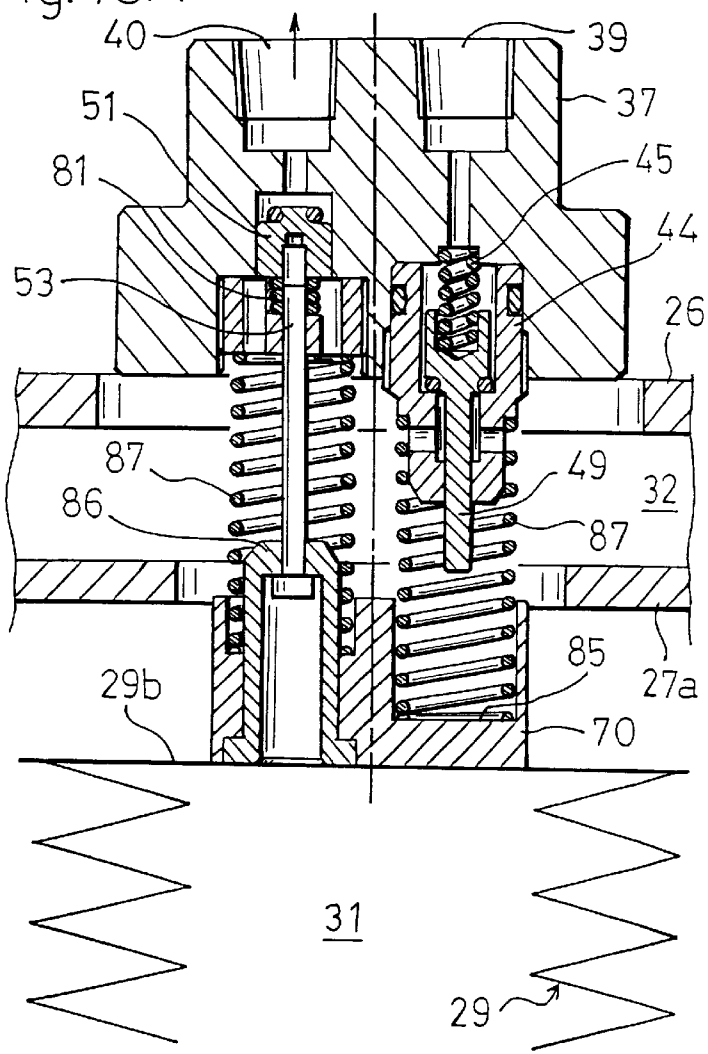
FIG. 16A is a view showing operations of the air supply valve and the air discharge valve of the automatic pressure regulating mechanism in the case where the fluid pressure in the bellows of the accumulator is lowered.
Figure 16B:
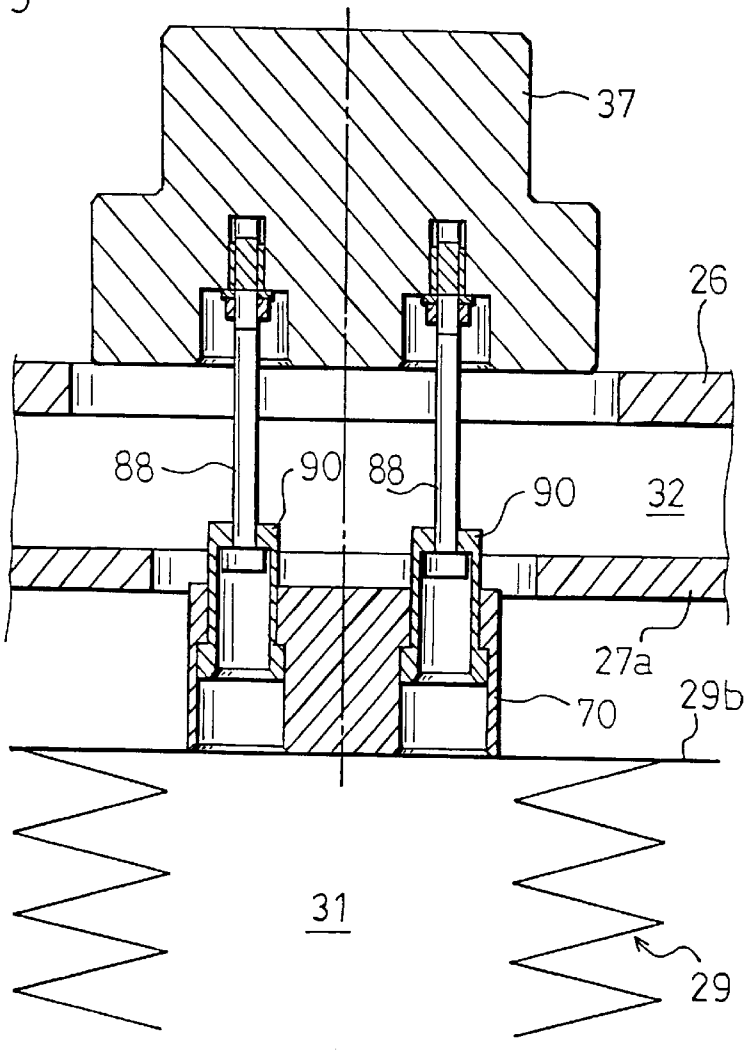
FIG. 16B is a view showing operations of the guide shaft and the guide sleeve of the automatic pressure regulating mechanism in the case where the fluid pressure in the bellows of the accumulator is lowered.

On the other hand, when the discharge pressure of the reciprocating pump P is lowered, the capacity of the liquid chamber 31 is reduced by the transported liquids, and the pressure in the air chamber 32 overcomes the fluid pressure in the liquid chamber 31, so that the barrier membrane 29 is contractingly deformed. As shown in FIGS. 16A and 16B, this contracting deformation of the barrier membrane 29 causes the air supply/discharge valve control disk 70 to, in accordance with the movement of the closed upper end portion 29*b* of the barrier membrane 29 in the contracting direction, be moved in the same direction while receiving the urging force of the springs 87. The air discharge valve rod 53 which is coupled to the discharge valve rod pulling portion 86 of the air supply/discharge valve control disk 70 is pulled in the same direction, whereby the discharge valve element 51 is changed to the opening state. Therefore, the compressed air in the air chamber 32 is discharged to the atmosphere through the air discharge port 40 to lower the filling pressure in the air chamber 32. In accordance with the reduction of the filling pressure in the air chamber 32, the barrier membrane 29 is expanded. Then, the air supply/discharge valve control disk 70 is pushed by the center area of the closed upper end portion 29*b* of the barrier membrane 29, and the discharge valve element 51 is caused to close the air discharge port 40 by the urging action of the spring 81. As a result, the filling pressure in the air chamber 32 is fixed to the adjusted state.

As described above, when a fluid pressure is applied to the barrier membrane 29, the compressed air is sucked or discharged until balance with the pressure is attained, whereby pulsations are efficiently-absorbed and the amplitude of pulsations is suppressed to a low level, irrespective of variation of the discharge pressure of the reciprocating pump P.

As described above, the supply valve element 44 and the discharge valve element 51 which are separately and independently disposed in the valve case 37 are subjected to the valve-opening control in accordance with the expansion and contraction of the barrier membrane 29, via the air supply valve rod pressing portion 85 and the discharge valve rod pulling portion 86 on the air supply/discharge valve control disk 70. Since the air supply/discharge valve control disk 70 is placed so as to always abut against the center area of the closed upper end portion 29*b* of the barrier membrane 29, no offset load is applied to the barrier membrane 29 even when the air supply valve element 44 and the discharge valve element 51 are juxtaposed separately and independently in the valve case 37. Therefore, the barrier membrane 29 is always straightly expandingly and contractingly deformed in the axial direction X—X of the valve case 37, whereby the responsibility of the opening and closing operations of the air supply and discharge valve elements 44 and 51 can be improved and the performance of reducing pulsations can be ensured. The air supply/discharge valve control disk 70 can be always enabled to be moved in parallel stably and surely by the guiding action of the guide shafts 88. Consequently, the air supply and discharge valve elements 44 and 51 can faithfully perform the opening and closing operations corresponding to expansion and contraction of the barrier membrane 29, via the air supply/discharge valve control disk 70.

In the accumulator A of the above-described embodiment, the automatic pressure regulating mechanism which consists of the automatic air supply valve mechanism 41 and the automatic air discharge valve mechanism 42 is attached to the air chamber 32. The air chamber 32 is required only to have the opening 35 for allowing air to inflow and outflow, and is not always requested to have the automatic pressure regulating mechanism. The pressure adjustment may be manually performed.

In the above embodiments, the barrier membrane 7 of the reciprocating pump P and the barrier membrane 29 of the accumulator A are disposed with vertically directing their axes B and C. It is a matter of course that the invention can be similarly applied to the reciprocating pump P and the accumulator A of the type in which the barrier membrane 7 of the reciprocating pump P and the barrier membrane 29 of the accumulator A are disposed with horizontally directing their axes B and C.

In the suction check valve 20 and the discharge check valve 21 of the reciprocating pump P, the gravity closing mechanism which is due to the ball valve elements 202 or 221, and in which a spring for urging a ball is not used is employed. This is advantageous because, even in the case where liquids containing a precipitable material such as slurry are used, such precipitable material is prevented from staying or aggregating inside the check valves 20 and 21. The structure of the suction check valve 20 and the discharge check valve 21 is not restricted to this structure, and may have a mechanism in which a spring for urging a ball is used.

In the embodiments described above, each of the suction check valve 20 and the discharge check valve 21 is provided with the ball valve elements 202 or 221 which are arranged vertically in two stages, so as to have a double closing structure. This structure is advantageous because quantitative supply of the transported liquids can be ensured. The structure of the valves is not restricted to this. The valves may have a single ball valve element 202 or 221 (see FIG. 2).

The barrier membrane 7 of the reciprocating pump P and the barrier membrane 29 of the accumulator A are not restricted to bellows, and may be configured by diaphragms.

The entire disclosure of Japanese Patent Application No. 2000-034838 filed on Feb. 14, 2000 including specification, claims, drawings, and summary are incorporated herein by reference in its entirety.

What is claimed is:

1. A fluid apparatus configured by a reciprocating pump in which a barrier membrane configured as a bellows or a diaphragm that is reciprocally moved in an axial direction is disposed in a pump body so as to form a liquid chamber between said barrier membrane and an inner wall of said pump body, a suction port and a discharge port are disposed in said inner wall of said pump body facing said liquid chamber, said suction port having an inlet portion, a stroke of sucking two or more different kinds of liquids from said suction port into said liquid chamber by reciprocal motion of said barrier membrane, and a stroke of discharging the liquids in said liquid chamber from said discharge port are alternately performed, wherein an outlet portion of said suction port facing said liquid chamber is opened so as to eject sucked liquids toward a circumferential wall of said liquid chamber, said circumferential wall being located in a direction different from the axial direction, supply pipes respectively for the two or more kinds of liquids are pipe-connected to said inlet portion of said suction port so as to join together, and an outlet portion of said suction port facing said liquid chamber is disposed in a side face of a protruding forward end of a suction check valve which is fixed to protrude from said inner wall of said pump body facing said liquid chamber, into said liquid chamber.

2. A fluid apparatus configured by a reciprocating pump in which a barrier membrane configured as a bellows or a diaphragm that is reciprocally moved in an axial direction is disposed in a pump body so as to form a liquid chamber between said barrier membrane and an inner wall of said pump body, a suction port and a discharge port are disposed in said inner wall of said pump body facing said liquid chamber, said suction port having an inlet portion, a stroke of sucking two or more different kinds of liquids from said suction port into said liquid chamber by reciprocal motion of said barrier membrane, and a stroke of discharging the liquids in said liquid chamber from said discharge port are alternately performed, wherein an outlet portion of said suction port facing said liquid chamber is opened so as to eject sucked liquids toward a circumferential wall of said liquid chamber, said circumferential wall being located in a direction different from the axial direction, inflow paths respectively for the two or more kinds of liquids are individually disposed in said pump body, and outlets of said inflow paths are communicatingly formed in said inlet portion of said suction port so as to join together in said inlet portion, and an outlet portion of said suction port facing said liquid chamber is disposed in a side face of a protruding forward end of a suction check valve which is fixed to protrude from said inner wall of said pump body facing said liquid chamber, into said liquid chamber.

3. A fluid apparatus configured by an accumulator in which a barrier membrane configured as a bellows or a diaphragm that is reciprocally moved in an axial direction is disposed in an accumulator body so as to form a liquid chamber inside said barrier membrane, two or more different kinds of liquids being to flow into said liquid chamber, and an air chamber outside said barrier membrane, an inflow port and an outflow port are disposed in an inner wall of said accumulator body facing said liquid chamber, a liquid pressure in said liquid chamber is balanced with an air pressure in said air chamber, wherein an outlet portion of said inflow port facing said liquid chamber is opened so as to eject sucked liquids toward a circumferential wall of said liquid chamber, said circumferential wall being located in a direction other than the axial direction, supply pipes respectively for the two or more different kinds of liquids are pipe-connected to an inlet portion of said inflow port so as to join together, and an outlet portion of said inflow port facing said liquid chamber is disposed in a side face of a protruding forward end of a discharge check valve which is fixed to protrude from said inner wall of said accumulator body facing said liquid chamber, into said liquid chamber.

4. A fluid apparatus configured by an accumulator in which a barrier membrane configured as a bellows or a diaphragm that is reciprocally moved in an axial direction is disposed in an accumulator body so as to form a liquid chamber inside said barrier membrane, two or more different kinds of liquids being to flow into said liquid chamber, and an air chamber outside said barrier membrane, an inflow port and an outflow port are disposed in an inner wall of said accumulator body facing said liquid chamber, said inflow port having an inlet portion, and a liquid pressure in said liquid chamber is balanced with an air pressure in said air chamber, wherein an outlet portion of said inflow port facing said liquid chamber is opened so as to eject sucked liquids toward a circumferential wail of said liquid chamber, said circumferential wall being located in a direction other than the axial direction, inflow paths respectively for the two or more kinds of liquids are individually disposed in said accumulator body, and outlets of said inflow paths are communicatingly formed in said inlet portion of said inflow port so as to join together in said inlet portion, and an outlet portion of said inflow port facing said liquid chamber is disposed in a side face of a protruding forward end of a discharge check valve which is fixed to protrude from said inner wall of said accumulator body facing said liquid chamber, into said liquid chamber.

* * * * *